US009502802B2

(12) United States Patent
Dubal et al.

(10) Patent No.: US 9,502,802 B2
(45) Date of Patent: Nov. 22, 2016

(54) APPARATUS AND METHOD FOR USING CONDUCTIVE ADHESIVE FIBERS AS A DATA INTERFACE

(71) Applicant: Intel Corporation, Santa Clara, CA (US)

(72) Inventors: Scott P. Dubal, Beaverton, OR (US); Douglas D. Boom, Portland, OR (US); Patrick Connor, Beaverton, OR (US); Chris Pavlas, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 177 days.

(21) Appl. No.: 14/317,383

(22) Filed: Jun. 27, 2014

(65) Prior Publication Data

US 2015/0380843 A1 Dec. 31, 2015

(51) Int. Cl.

| | |
|---|---|
| ***H01R 11/12*** | (2006.01) |
| ***H01R 24/66*** | (2011.01) |
| ***H01R 13/20*** | (2006.01) |
| *A41D 1/00* | (2006.01) |

(52) U.S. Cl.
CPC ..... *H01R 13/20* (2013.01); *A41D 1/005* (2013.01)

(58) Field of Classification Search
CPC ..... H01R 24/66; H01R 11/12; H01R 13/20
See application file for complete search history.

(56) References Cited

U.S. PATENT DOCUMENTS

| | | | | |
|---|---|---|---|---|
| 5,774,341 | A | 6/1998 | Urbish et al. | |
| 7,524,195 | B2 | 4/2009 | Ales et al. | |
| 7,769,412 | B1 * | 8/2010 | Gailloux | H04M 1/05 455/419 |
| 8,144,911 | B2 * | 3/2012 | Chiang | H04R 19/013 381/172 |
| 8,215,973 | B2 | 7/2012 | Ales et al. | |
| 2002/0084901 | A1 | 7/2002 | Mantyjarvi et al. | |
| 2002/0197960 | A1 * | 12/2002 | Lee | A41D 1/005 455/66.1 |
| 2008/0271220 | A1 | 11/2008 | Chilton et al. | |
| 2009/0326417 | A1 * | 12/2009 | Ales, III | A61F 13/84 600/584 |
| 2010/0004715 | A1 * | 1/2010 | Fahey | A61H 39/002 607/48 |
| 2010/0075511 | A1 | 3/2010 | Kim et al. | |

FOREIGN PATENT DOCUMENTS

| | | | |
|---|---|---|---|
| EP | 1 905 579 | A1 | 4/2008 |
| WO | 2008/070824 | A2 | 6/2008 |

OTHER PUBLICATIONS

International Search Report and Written Opinion received for PCT Patent Application No. PCT/US2015/031321, mailed on Jul. 23, 2015, 12 pages.

(Continued)

*Primary Examiner* — Briggitte R Hammond
(74) *Attorney, Agent, or Firm* — Inventive Patent Law, P.C.; Jim H. Salter

(57) ABSTRACT

An apparatus and method for using conductive adhesive fibers as a data interface are disclosed. A particular embodiment includes: a first array of conductive adhesive fiber fastener pads configured for attachment to a first item; a second array of conductive adhesive fiber fastener pads configured for attachment to a second item, each pad of the first and second array being fabricated with a hook or loop removable fastener, each removable fastener being electrically conductive, the first array of pads being arranged to align with the second array of pads to create a plurality of independent electrical connections when the first item is removably attached to the second item, the plurality of independent electrical connections establishing a data interface connection between the first item and the second item.

10 Claims, 6 Drawing Sheets

(56) References Cited

OTHER PUBLICATIONS

Retrieved from: https://www.inventables.com/technologies/conductive-hook-and-loop, "Conductive Hook and Loop," web page, 1 page, retrieved date: May 26, 2014.

Office Action and Search Report received for Taiwanese Patent Application No. 104116252, mailed on Aug. 10, 2016, 6 pages of Taiwanese Office Action including 1 page of English translated search report.

* cited by examiner

APPARATUS AND METHOD FOR USING CONDUCTIVE ADHESIVE FIBERS AS A DATA INTERFACE

TECHNICAL FIELD

This patent application relates to electronic systems, wearable devices, mobile devices, and electronic-enabled apparel according to various example embodiments, and more specifically to an apparatus and method for using conductive adhesive fibers as a data interface.

BACKGROUND

Computing devices, communication devices, imaging devices, electronic devices, accessories, or other types of peripheral devices designed to be worn or attached to a user (denoted as wearables or wearable devices) are becoming very popular. Wearables can be considered to be a form of mobile device. Mobile phones with headsets or earbud accessories, the Google® Glass™ wearable computer, and garments with embedded phones or music players are examples of such wearables or mobile devices.

The wearable's device market space is expected to substantially grow in the coming years. A good portion of these devices will be wearable's that are designed directly into or onto an article of clothing; because, the device will need to be connected to a series of sensors that are woven into the clothing itself. However, using current technology, if the user of an article of clothing wants to upgrade/repair/replace the wearable that is embedded into their clothing, the user would have to buy a brand new article of clothing.

Adhesive fibers, touch fasteners, or hook and loop fasteners are more commonly known by their brand name, Velcro®. Velcro® brand fasteners work well for binding items together and provide a high level of retention force while still being readily removable. A form of conductive Velcro® is also available in the current marketplace. Conventional conductive Velcro® comprises a hook and loop mechanism that conducts electricity. Conductive Velcro® is manufactured using woven nylon material impregnated with silver for electrical conduction. Existing solutions use conductive Velcro® to integrate soft electrical switches into fabrics or soft-goods products.

Other known solutions involve hard case components with binding retention systems that are both bulky and a source of product failure. For example, a current product, the internally illuminated child's pillow, includes a battery case that is large, bulky, and the device is hard to access. Other known solutions bind fasteners directly to a printed circuit (PC) board. However, these systems are also bulky and a source of product failure.

BRIEF DESCRIPTION OF THE DRAWINGS

The various embodiments are illustrated by way of example, and not by way of limitation, in the figures of the accompanying drawings in which.

DETAILED DESCRIPTION

In the following description, for purposes of explanation, numerous specific details are set forth in order to provide a thorough understanding of the various embodiments. It will be evident, however, to one of ordinary skill in the art that the various embodiments may be practiced without these specific details.

In the various embodiments described herein, an apparatus and method for using conductive adhesive fibers as a data interface are disclosed. The various embodiments described herein provide various ways to readily attach or detach wearable electronic devices or mobile electronic devices to garments, articles of clothing, or other wearables. The attachment mechanism comprises a conductive adhesive fiber fastener supporting an electrical data interface to enable a wearable electronic device to communicate with electrical data components in a garment, article of clothing, or other wearable.

Figure 1:
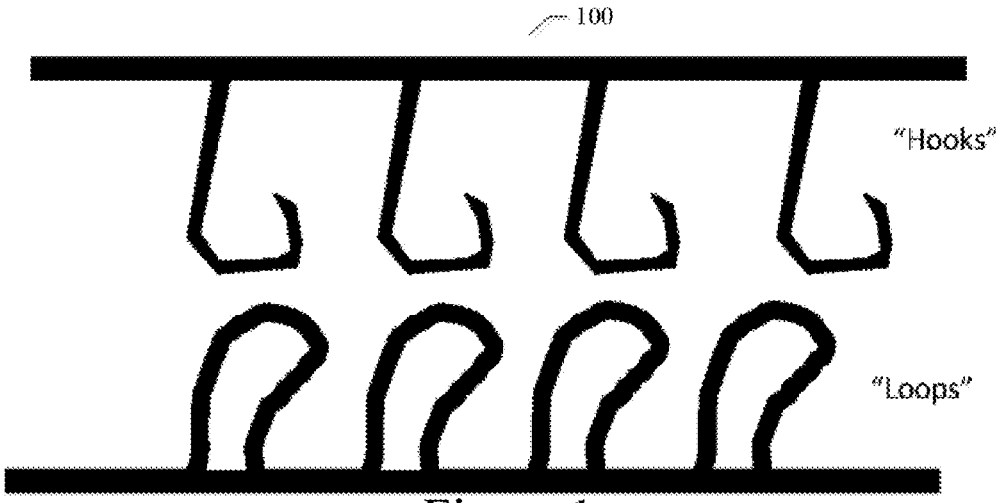
Figure 1 (Prior Art)
FIG. 1 illustrates the hooks and loops of an adhesive fiber fastener just before connection.
Figure 2:
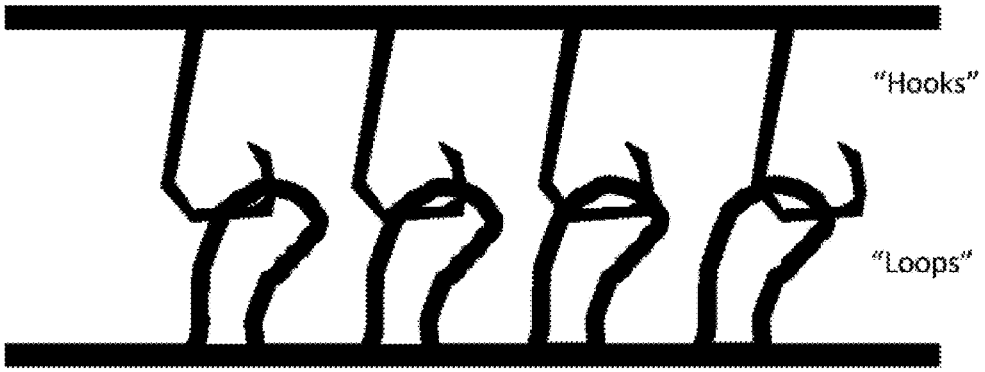
Figure 2 (Prior Art)
FIG. 2 illustrates the hooks and loops of an adhesive fiber fastener after connection.

Referring now to FIGS. 1 and 2, adhesive fibers are typically hook and loop micro fibers that create a high level of retention force by having hundreds or thousands of individual links binding the two sides of a fastener together. Individually each hook and loop is easy to break; however, hundreds or thousands of linked hooks and loops are much harder to break. Conventional hook and loop fasteners are more commonly known by their brand name, Velcro®. Because the hooks and loops of the two sides of the fastener make physical contact, if the fibers themselves are conductive, that makes the whole unit conductive. A form of conductive Velcro® is available in the current marketplace. Conventional conductive Velcro® comprises a hook and loop mechanism that conducts electricity. Conductive Velcro® is manufactured using woven nylon material impregnated with silver for electrical conduction. It will be apparent to those of ordinary skill in the art that other conductive materials can also be integrated with the hook and loop mechanism of a conductive adhesive fiber fastener. FIG. 1 illustrates the hooks and loops of a conventional adhesive fiber fastener just before connection. FIG. 2 illustrates the hooks and loops of a conventional adhesive fiber fastener after connection.

The conventional use of conductive adhesive fiber fasteners is mainly for electrical switching. In other words, if the two parts of the conductive adhesive fiber fastener are disconnected, the electrical circuit is open, electrical current cannot flow, and the related switch is off. On the other hand, if the two parts of the conductive adhesive fiber fastener are connected, the electrical circuit is closed, electrical current can flow, and the related switch is on.

The various embodiments described herein extend this simplistic switching concept to a fully enabled data interface implemented with a plurality of independent but related conductive pads. Each conductive pad is implemented as a conductive adhesive fiber fastener. In an example embodiment, the conductive hooks and loops of a conductive adhesive fiber fastener are separated into discrete areas or pads, which are electrically isolated from other areas of other conductive hooks and loops. As a result, a conductivity grid, similar to today's pin outs for semiconductor devices, can be created with a plurality of conductive adhesive fiber fastener pads (denoted herein as conductive pads). The spacing between the conductive pads and the size or shape of each conductive pad can be configured based on the voltage and electrical current needed for each data signal or power source being routed through a particular conductive pad.

Figure 3:
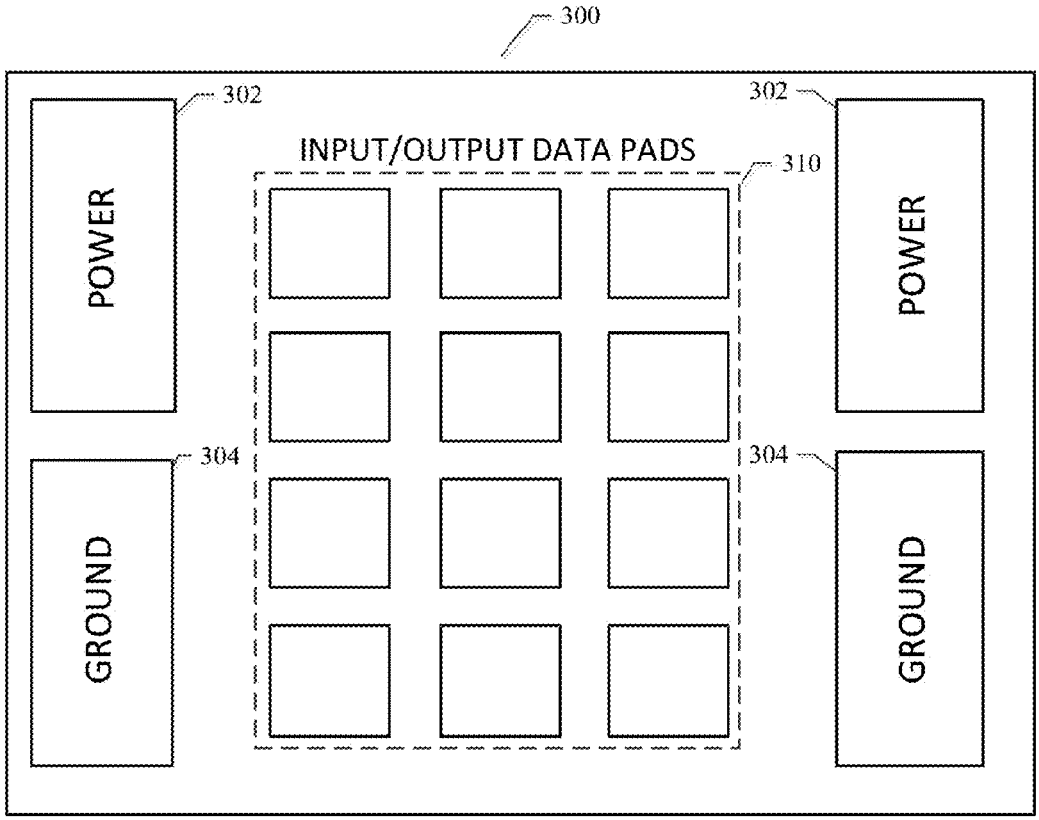
FIG. 3 illustrates an example embodiment of an apparatus and method for using conductive adhesive fibers as a data interface.

FIG. 3 illustrates an example embodiment of a data interface implemented as an array of conductive pads. Such a data interface can be integrated with a wearable device processor or wearable electronics package, for example. As shown in FIG. 3, the conductive adhesive fiber data interface 300, implemented as an array of conductive pads, comprises a plurality of power pads 302 through which electrical power can be sourced, a plurality of ground pads 304 through which an electrical ground can be connected, and a plurality of data pads 310 dedicated to specific data signals. Note that the data interface 300 of an example embodiment uses a plurality of conductive adhesive fiber fastener pads, not pins. These conductive pads are discrete areas of conductive fibers that relate to specific functions of the data interface 300. In a particular example embodiment, the conductive fibers of each pad can be fabricated from a highly conductive material, as described above, which can handle a large voltage range. Alternatively, if the voltage requirement is small, a less expensive conductive material can be used for a particular pad or the pad area can be reduced in size as needed. Additionally, the spacing between pads of the data interface 300 can be varied depending on the voltage requirements and the need to eliminate cross-talk or shorts between pads. As shown in the example embodiment of FIG. 3, the power pads 302 and ground pads 304 are fabricated as larger areas than the data pads 310; because, the power pads 302 and ground pads 304 will typically be required to support a wider voltage range than the data pads 310.

In a particular embodiment, the array of data pads 310 can be configured to support a variety of existing data interface standards, such as Universal Serial Bus (USB), Serial-ATA, PCI Express™, Serial Peripheral Interface (SPI), or I2C. Universal Serial Bus (USB) is an industry standard developed to define protocols for cables, connectors, and data communications used in a bus for connection, communication, and power supply between computers and electronic devices. Serial ATA (SATA) is a standard computer bus interface that connects host bus adapters to mass storage devices, such as hard disk drives and optical drives. PCI Express (Peripheral Component Interconnect Express), also abbreviated as PCIe, is a high-speed serial computer expansion bus standard designed to provide numerous improvements over the prior bus standards, including higher maximum system bus throughput, lower I/O pin count, and better performance scaling for bus devices. The Serial Peripheral Interface or SPI bus is a synchronous serial data link named by Motorola™, which operates in a full duplex mode. I2C (Inter-Integrated Circuit, I2C, or IIC) is a multi-master serial single-ended computer bus used for attaching low-speed peripherals to a motherboard, an embedded system, a cellphone, or other digital electronic devices. It will be apparent to those of ordinary skill in the art in view of the disclosure herein that a variety of other standard computer, data, or communication interface standards can be similarly supported by the appropriate provisioning and arrangement of conductive adhesive fiber fastener pads as disclosed herein.

Figure 4:
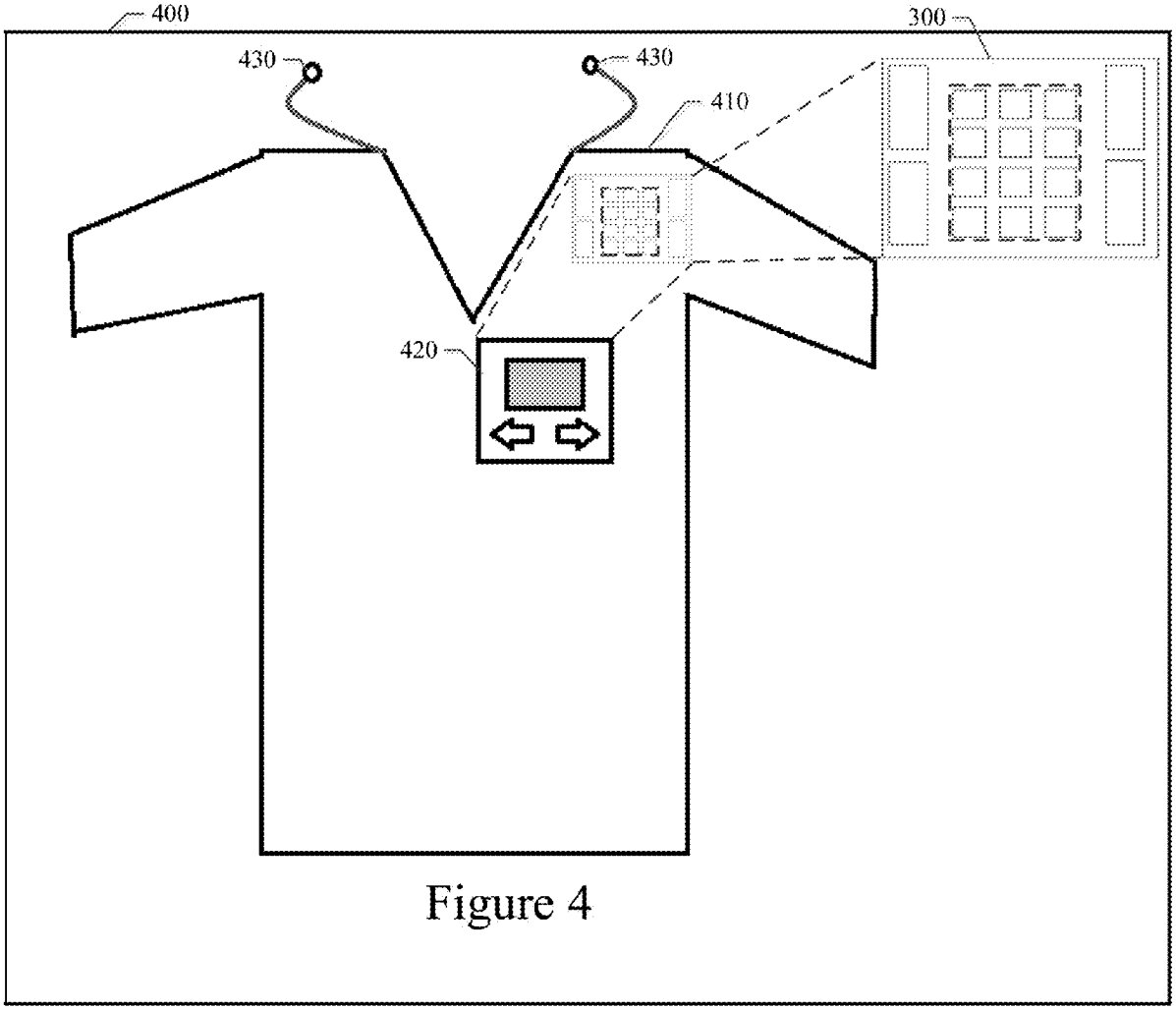
FIG. 4 illustrates an example embodiment of a mobile device or wearable device integrated with a garment using the conductive adhesive fiber data interface as disclosed herein.

FIG. 4 illustrates an example embodiment 400 of a mobile device or wearable device 420 integrated with a garment 410 using the conductive adhesive fiber data interface 300 as disclosed herein. Because the conductive adhesive fibers of the data interface of the example embodiment are flexible, the conductive adhesive fiber data interface 300 can be integrated into a garment 410 that can be worn by a user. For example, the conductive adhesive fiber data interface 300 can be woven or stitched into a garment as shown in FIG. 4. Once the conductive adhesive fiber data interface 300 is integrated into garment 410, a mobile device or wearable device 420 can be removably attached to the data interface 300 using the conductive adhesive fiber pads of the data interface 300 as shown in FIGS. 3 and 4 and described above. Each of the pads of the data interface 300 can be removably connected to a corresponding pad of the mobile device or wearable device 420 to establish a data interface connection between the mobile device or wearable device 420 and the electronic components of the garment 410. In one example embodiment as shown in FIG. 4, the electronic components of the garment 410 can include earbuds 430 with conductive wires connecting the conductive adhesive fiber data interface 300 with the earbuds 430. When the mobile device or wearable device 420 is removably connected with the data interface 300 via the conductive adhesive fiber pads, the mobile device or wearable device 420 becomes electrically connected and integrated with the electronic components of the garment 410. Given the data interface implemented by the data pads 310 of data interface 300, the mobile device or wearable device 420 becomes electrically connected to the electronic components of the garment 410 as if a standard protocol-specific connector and wire had been connected to the mobile device or wearable device 420. In this manner, the electronic components of the garment 410 can be electrically connected to the mobile device or wearable device 420. Additionally, the electronic components of the garment 410 can be removably connected to the mobile device or wearable device 420. In this manner, a variety of different mobile devices or wearable devices 420 can be removably connected to the electronic components 430 of the garment 410 via the data interface 300. As long as the mobile device or wearable device 420 being attached complies with the standard interface implemented by the data interface 300, the mobile device or wearable device 420 will operate with the electronic components 430 of the garment 410. Because the data interface 300 provides a removably connectable interface, a mobile device or wearable device 420 can be easily upgraded, replaced, or fixed.

Thus, as described herein, the apparatus of an example embodiment can comprise: a first array of conductive adhesive fiber fastener pads configured for attachment to a first item; a second array of conductive adhesive fiber fastener pads configured for attachment to a second item, each pad of the first and second array being fabricated with a hook or loop removable fastener, each removable fastener being electrically conductive, the first array of pads being arranged to align with the second array of pads to create a plurality of independent electrical connections when the first item is removably attached to the second item, the plurality of independent electrical connections establishing a data interface connection between the first item and the second item.

In the example embodiment as described herein, the first item can be a wearable item and the second item can be a mobile device or wearable device. In the example embodiment as described herein, the data interface connection can include a data interface standard from the group consisting of: Serial-ATA and Peripheral Component Interconnect Express (PCIe or PCI Express). The first and second array of conductive adhesive fiber fastener pads can include a plurality of power pads, a plurality of ground pads, and a plurality of data pads. It will be apparent to those of ordinary skill in the art in view of the disclosure herein that a variety of other configurations can be implemented in the manner described herein.

In the example shown in FIG. 4, one use case of an example embodiment described herein is to provide a garment 410 (e.g., a shirt) that has integrated electronic components 430 (e.g., detachable ear buds). As shown in FIG. 4, a user can attach a mobile device or wearable device 420 (e.g., a portable music player) to the garment 410 using the data interface 300 that includes an array of conductive fiber pads. The portable music player uses the conductive pads of the data interface 300 to connect to the ear buds, or other integrated electronic components, so that the user has no dangling cords that can get tangled. The user can also transfer the portable music player to other various garments that support the same data interface 300. For example, using the embodiments described herein, the wearable electronic device (e.g., a music player) itself can be removed from a first garment and relocated to another garment with very low risk of damaging the data interface. It will be apparent to those of ordinary skill in the art in view of the disclosure herein that a variety of types of mobile devices or wearable devices can use the conductive pads of the data interface 300 to create a data connection with a variety of types of integrated electronic components in a variety of types of garments, articles of clothing, wearables, backpacks, luggage, upholstery, or other items made from fabric or soft materials. In various embodiments, the mobile devices or wearable devices and the integrated electronic components can include any of a variety of computing or communication components, music players or audio components, data processors, memory, interfaces, power control circuitry, transceiver circuitry, geo-positioning receiver components, and the like.

Figure 5:
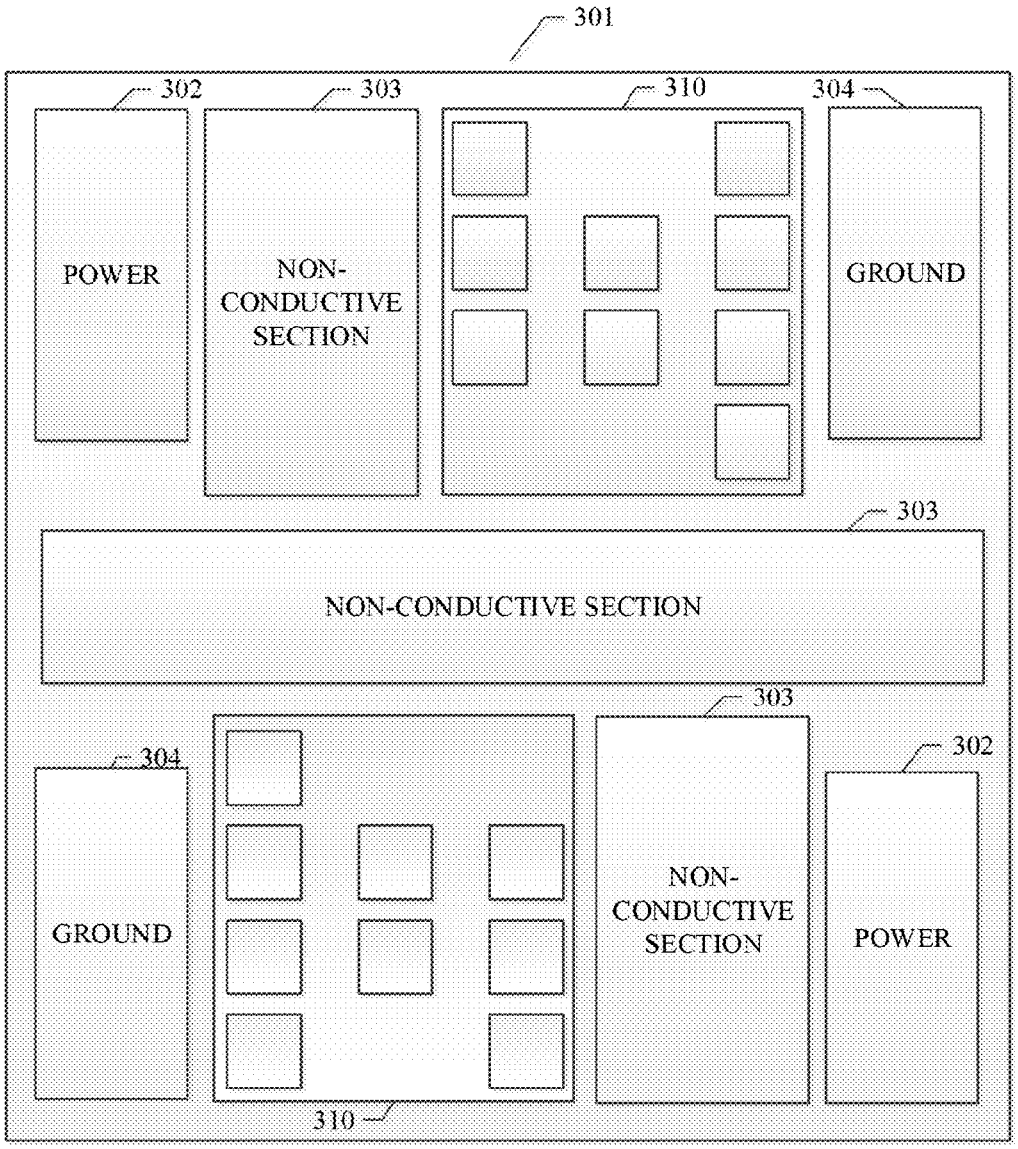
FIG. 5 illustrates another example embodiment of an apparatus and method for using conductive adhesive fibers as a data interface.

FIG. 5 illustrates another example embodiment of an apparatus and method for using conductive adhesive fibers as a data interface. As shown in the example of FIG. 5, the conductive adhesive fiber data interface 301 includes non-conductive sections 303 to support the attachment of the two connecting portions of the data interface and to provide separation and electrical isolation between the conductive portions of the data interface. Additionally, the portions of the data interface 301 can be configured to enable the two portions of the data interface to be attached in more than one way. Note in the example of FIG. 5 that the components of the data interface 301 are replicated and positioned in a reverse configuration between the upper (top) half of the data interface and the lower (bottom) of the data interface. As such, the two connecting portions of the data interface can be connected top to top or top to bottom. Additionally, processing logic in support of the data interface 301 can automatically determine which set of pads of the data interface have been electrically connected. As such, the processing logic can determine the orientation by which the two connecting portions of the data interface have been connected. Thus, the signals on the data pads 310 and the power source at the power pad 302 of the data interface 301 can be properly and automatically routed or re-routed to enable data communications via the data interface. It will be apparent to those of ordinary skill in the art in view of the disclosure herein that a variety of different configurations of the data interface components as described herein can be implemented.

Figure 6:
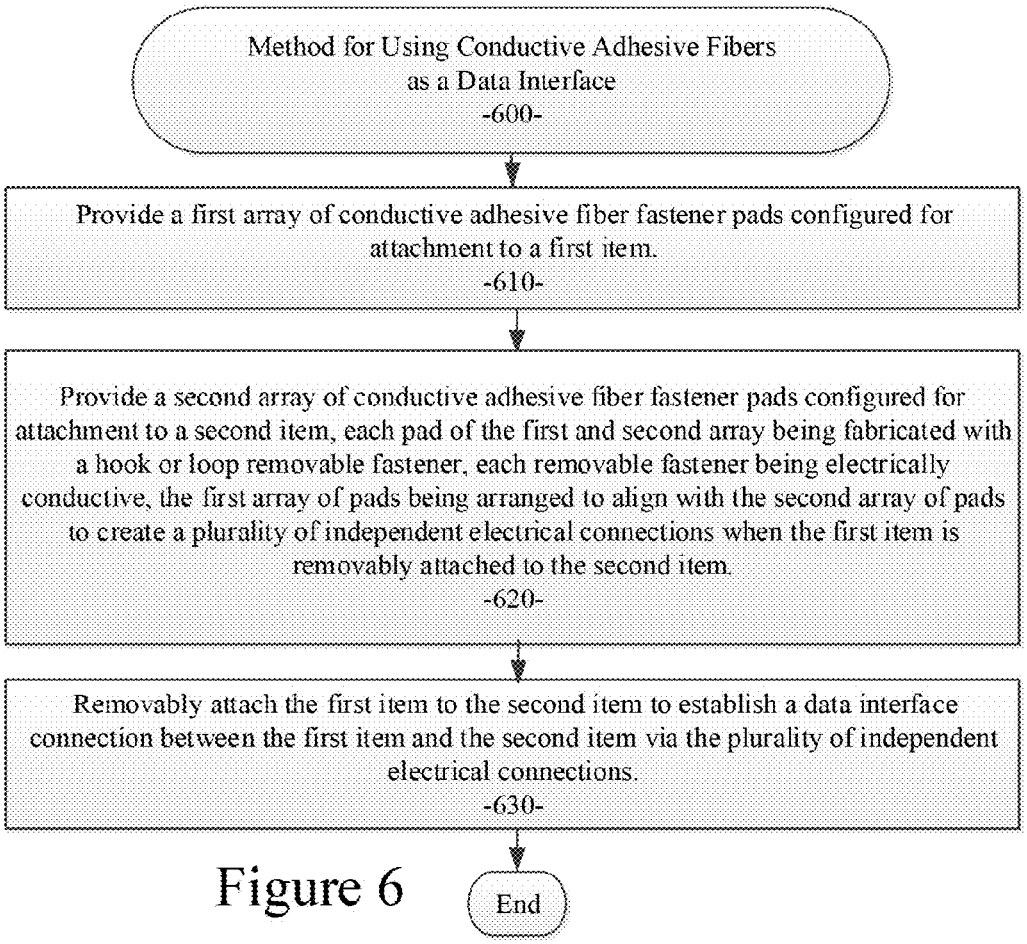
FIG. 6 is a flow chart illustrating an example embodiment of a method for using conductive adhesive fibers as a data interface as described herein.

Referring now to FIG. 6, a flow diagram illustrates an example embodiment of a method for using conductive adhesive fibers as a data interface as described herein. The method 600 of an example embodiment includes: providing a first array of conductive adhesive fiber fastener pads configured for attachment to a first item (processing block 610); providing a second array of conductive adhesive fiber fastener pads configured for attachment to a second item, each pad of the first and second array being fabricated with a hook or loop removable fastener, each removable fastener being electrically conductive, the first array of pads being arranged to align with the second array of pads to create a plurality of independent electrical connections when the first item is removably attached to the second item (processing block 620); and removably attaching the first item to the second item to establish a data interface connection between the first item and the second item via the plurality of independent electrical connections (processing block 630).

Figure 7:
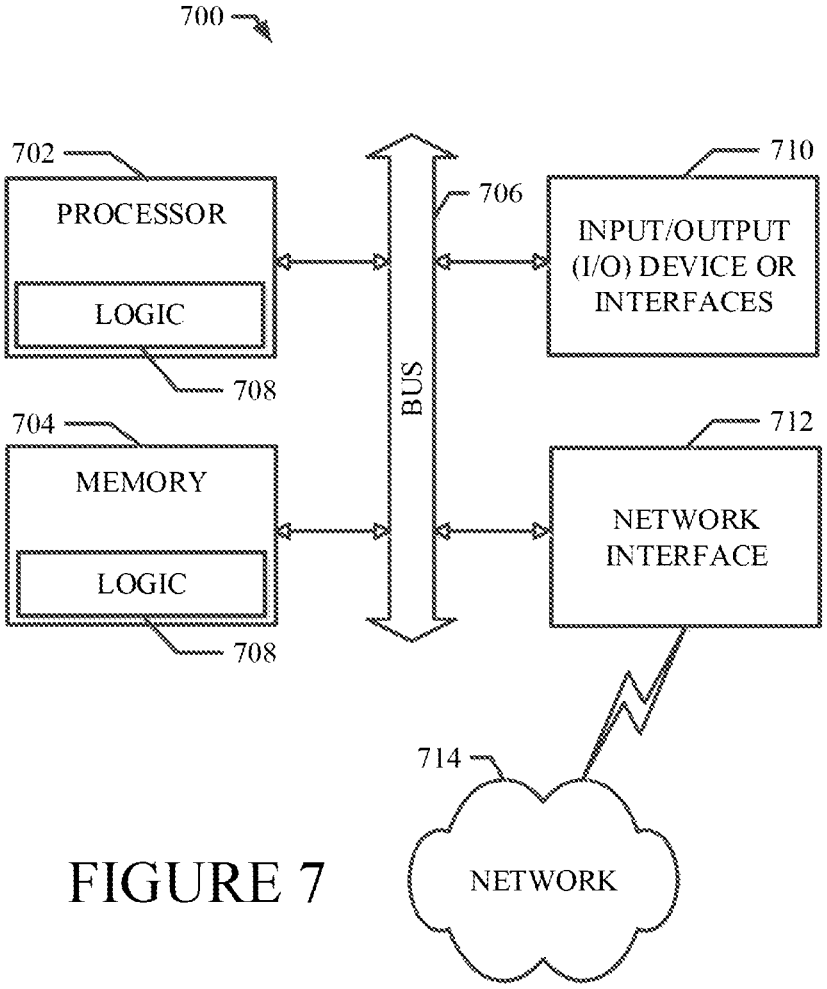
FIG. 7 shows a diagrammatic representation of a machine in the example form of a mobile computing and/or communication system within which a set of instructions when executed and/or processing logic when activated may cause the machine to perform any one or more of the methodologies described and/or claimed herein.

FIG. 7 shows a diagrammatic representation of a machine in the example form of a mobile computing and/or communication system 700 within which a set of instructions when executed and/or processing logic when activated may cause the machine to perform any one or more of the methodologies described and/or claimed herein. In alternative embodiments, the machine operates as a standalone device or may be connected (e.g., networked) to other machines. In a networked deployment, the machine may operate in the capacity of a server or a client machine in server-client network environment, or as a peer machine in a peer-to-peer (or distributed) network environment. The machine may be a personal computer (PC), a laptop computer, a tablet computing system, a Personal Digital Assistant (PDA), a cellular telephone, a smartphone, a web appliance, a set-top box (STB), a network router, switch or bridge, or any machine capable of executing a set of instructions (sequential or otherwise) or activating processing logic that specify actions to be taken by that machine. Further, while only a single machine is illustrated, the term "machine" can also be taken to include any collection of machines that individually or jointly execute a set (or multiple sets) of instructions or processing logic to perform any one or more of the methodologies described and/or claimed herein.

The example mobile computing and/or communication system 700 includes a data processor 702 (e.g., a System-on-a-Chip (SoC), general processing core, graphics core, and optionally other processing logic) and a memory 704, which can communicate with each other via a bus or other data transfer system 706. The mobile computing and/or communication system 700 may further include various input/output (I/O) devices and/or interfaces 710, such as a touchscreen display, an audio jack, and optionally a network interface 712. In an example embodiment, the network interface 712 can include one or more radio transceivers configured for compatibility with any one or more standard wireless and/or cellular protocols or access technologies (e.g., 2nd (2G), 2.5, 3rd (3G), 4th (4G) generation, and future generation radio access for cellular systems, Global System for Mobile communication (GSM), General Packet Radio Services (GPRS), Enhanced Data GSM Environment (EDGE), Wideband Code Division Multiple Access (WCDMA), LTE, CDMA2000, WLAN, Wireless Router (WR) mesh, and the like). Network interface 712 may also be configured for use with various other wired and/or wireless communication protocols, including TCP/IP, UDP, SIP, SMS, RTP, WAP, CDMA, TDMA, UMTS, UWB, WiMax, Bluetooth, IEEE 802.11x, and the like. In essence, network interface 712 may include or support virtually any wired and/or wireless communication mechanisms by which information may travel between the mobile computing and/or communication system 700 and another computing or communication system via network 714.

The memory 704 can represent a machine-readable medium on which is stored one or more sets of instructions, software, firmware, or other processing logic (e.g., logic 708) embodying any one or more of the methodologies or functions described and/or claimed herein. The logic 708, or a portion thereof, may also reside, completely or at least partially within the processor 702 during execution thereof by the mobile computing and/or communication system 700. As such, the memory 704 and the processor 702 may also constitute machine-readable media. The logic 708, or a portion thereof, may also be configured as processing logic or logic, at least a portion of which is partially implemented in hardware. The logic 708, or a portion thereof, may further be transmitted or received over a network 714 via the network interface 712. While the machine-readable medium of an example embodiment can be a single medium, the term "machine-readable medium" should be taken to include a single non-transitory medium or multiple non-transitory media (e.g., a centralized or distributed database, and/or associated caches and computing systems) that store the one or more sets of instructions. The term "machine-readable medium" can also be taken to include any non-transitory medium that is capable of storing, encoding or carrying a set of instructions for execution by the machine and that cause the machine to perform any one or more of the methodologies of the various embodiments, or that is capable of storing, encoding or carrying data structures utilized by or associated with such a set of instructions. The term "machine-readable medium" can accordingly be taken to include, but not be limited to, solid-state memories, optical media, and magnetic media.

In various embodiments as described herein, example embodiments include at least the following examples.

A data interface comprising:

a first array of conductive adhesive fiber fastener pads configured for attachment to a first item;

a second array of conductive adhesive fiber fastener pads configured for attachment to a second item, each pad of the first and second array being fabricated with a hook or loop removable fastener, each removable fastener being electrically conductive, the first array of pads being arranged to align with the second array of pads to create a plurality of independent electrical connections when the first item is removably attached to the second item, the plurality of independent electrical connections establishing a data interface connection between the first item and the second item.

The data interface as claimed above wherein the first item is a wearable item.

The data interface as claimed above wherein the second item is a mobile device or wearable device.

The data interface as claimed above wherein the data interface connection includes a data interface standard from the group consisting of: Universal Serial Bus (USB), Serial-ATA, and Peripheral Component Interconnect Express (PCIe or PCI Express).

The data interface as claimed above wherein the first and second array of conductive adhesive fiber fastener pads include a plurality of power pads, a plurality of ground pads, and a plurality of data pads.

An apparatus comprising:

a first array of conductive adhesive fiber fastening means configured for attachment to a first item;

a second array of conductive adhesive fiber fastening means configured for attachment to a second item, each fastening means of the first and second array being fabricated with a hook or loop removable fastener, each removable fastener being electrically conductive, the first array of fastening means being arranged to align with the second array of fastening means to create a plurality of independent electrical connections when the first item is removably attached to the second item, the plurality of independent electrical connections establishing a data interface connection between the first item and the second item.

The apparatus as claimed above wherein the first item is a wearable item.

The apparatus as claimed above wherein the second item is a mobile device or wearable device.

The apparatus as claimed above wherein the data interface connection includes a data interface standard from the group consisting of: Universal Serial Bus (USB), Serial-ATA, and Peripheral Component Interconnect Express (PCIe or PCI Express).

The apparatus as claimed above wherein the first and second array of conductive adhesive fiber fastening means include a plurality of power pads, a plurality of ground pads, and a plurality of data pads.

A method comprising:

providing a first array of conductive adhesive fiber fastener pads configured for attachment to a first item;

providing a second array of conductive adhesive fiber fastener pads configured for attachment to a second item, each pad of the first and second array being fabricated with a hook or loop removable fastener, each removable fastener being electrically conductive, the first array of pads being arranged to align with the second array of pads to create a plurality of independent electrical connections when the first item is removably attached to the second item; and removably attaching the first item to the second item to establish a data interface connection between the first item and the second item via the plurality of independent electrical connections.

The method as claimed above wherein the first item is a wearable item.

The method as claimed above wherein the second item is a mobile device or wearable device.

The method as claimed above wherein the data interface connection includes a data interface standard from the group consisting of: Universal Serial Bus (USB), Serial-ATA, and Peripheral Component Interconnect Express (PCIe or PCI Express).

The method as claimed above wherein the first and second array of conductive adhesive fiber fastener pads include a plurality of power pads, a plurality of ground pads, and a plurality of data pads.

A system comprising:

a first item being a mobile item or a wearable item;

a second item being a mobile device or wearable device;

a first array of conductive adhesive fiber fastener pads configured for attachment to the first item;

a second array of conductive adhesive fiber fastener pads configured for attachment to the second item, each pad of the first and second array being fabricated with a hook or loop removable fastener, each removable fastener being electrically conductive, the first array of pads being arranged to align with the second array of pads to create a plurality of independent electrical connections when the first item is removably attached to the second item, the plurality of independent electrical connections establishing a data interface connection between the first item and the second item.

The system as claimed above wherein the data interface connection includes a data interface standard from the group consisting of: Universal Serial Bus (USB), Serial-ATA, and Peripheral Component Interconnect Express (PCIe or PCI Express).

The system as claimed above wherein the first and second array of conductive adhesive fiber fastener pads include a plurality of power pads, a plurality of ground pads, and a plurality of data pads.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A data interface comprising:

a first array of conductive adhesive fiber fastener pads configured for attachment to a first item;

a second array of conductive adhesive fiber fastener pads configured for attachment to a second item, each pad of the first and second array being fabricated with a hook or loop removable fastener, each removable fastener being electrically conductive, the first array of pads being arranged to align with the second array of pads to create a plurality of independent electrical connections when the first item is removably attached to the second item, the plurality of independent electrical connections establishing a data interface connection between the first item and the second item, wherein the first and second array of conductive adhesive fiber fastener pads include a plurality of power pads, a plurality of ground pads, and a plurality of data pads.

2. The data interface as claimed in claim 1 wherein the first item is a wearable item.

3. The data interface as claimed in claim 1 wherein the second item is a mobile device or wearable device.

4. An apparatus comprising:

a first array of conductive adhesive fiber fastening means configured for attachment to a first item;

a second array of conductive adhesive fiber fastening means configured for attachment to a second item, each fastening means of the first and second array being fabricated with a hook or loop removable fastener, each removable fastener being electrically conductive, the first array of fastening means being arranged to align with the second array of fastening means to create a plurality of independent electrical connections when the first item is removably attached to the second item, the plurality of independent electrical connections establishing a data interface connection between the first item and the second item, wherein the first and second array of conductive adhesive fiber fastener means include a plurality of power pads, a plurality of ground pads, and a plurality of data pads.

5. The apparatus as claimed in claim 4 wherein the first item is a wearable item.

6. The apparatus as claimed in claim 4 wherein the second item is a mobile device or wearable device.

7. A method comprising:

providing a first array of conductive adhesive fiber fastener pads configured for attachment to a first item;

providing a second array of conductive adhesive fiber fastener pads configured for attachment to a second item, each pad of the first and second array being fabricated with a hook or loop removable fastener, each removable fastener being electrically conductive, the first array of pads being arranged to align with the second array of pads to create a plurality of independent electrical connections when the first item is removably attached to the second item, wherein the first and second array of conductive adhesive fiber fastener pads include a plurality of power pads, a plurality of ground pads, and a plurality of data pads; and removably attaching the first item to the second item to establish a data interface connection between the first item and the second item via the plurality of independent electrical connections.

8. The method as claimed in claim 7 wherein the first item is a wearable item.

9. The method as claimed in claim 7 wherein the second item is a mobile device or wearable device.

10. A system comprising:

a first item being a mobile item or a wearable item;

a second item being a mobile device or wearable device;

a first array of conductive adhesive fiber fastener pads configured for attachment to the first item;

a second array of conductive adhesive fiber fastener pads configured for attachment to the second item, each pad of the first and second array being fabricated with a hook or loop removable fastener, each removable fastener being electrically conductive, the first array of pads being arranged to align with the second array of pads to create a plurality of independent electrical connections when the first item is removably attached to the second item, the plurality of independent electrical connections establishing a data interface connection between the first item and the second item, wherein the first and second array of conductive adhesive fiber fastener pads include a plurality of power pads, a plurality of ground pads, and a plurality of data pads.

* * * * *